US006957732B2

(12) United States Patent
Corrick et al.

(10) Patent No.: US 6,957,732 B2
(45) Date of Patent: Oct. 25, 2005

(54) VENDING MACHINE HAVING DIRECT DATA LINK TO CASH DISPENSER

(75) Inventors: Joshua Corrick, Henderson, NV (US); Raymond Heidel, Las Vegas, NV (US)

(73) Assignee: JCM American Corporation, Las Vegas, NV (US)

( * ) Notice: Subject to any disclaimer, the term of this patent is extended or adjusted under 35 U.S.C. 154(b) by 199 days.

(21) Appl. No.: 10/455,937

(22) Filed: Jun. 6, 2003

(65) Prior Publication Data

US 2004/0069590 A1 Apr. 15, 2004

Related U.S. Application Data

(63) Continuation-in-part of application No. 09/722,856, filed on Nov. 27, 2000, now Pat. No. 6,742,644.

(51) Int. Cl.[7] ..... G07F 17/00
(52) U.S. Cl. ..... 194/206; 194/207; 194/320
(58) Field of Search ..... 194/206, 207, 194/217, 218, 320; 453/17

(56) References Cited

U.S. PATENT DOCUMENTS

| | | | | |
|---|---|---|---|---|
| 3,963,035 A | | 6/1976 | Levasseur | 133/2 |
| 4,347,924 A | | 9/1982 | Hayashi et al. | 194/1 |
| 4,470,496 A | | 9/1984 | Steiner | 194/4 |
| 4,499,982 A | | 2/1985 | Sugimoto et al. | 194/1 |
| 4,499,985 A | | 2/1985 | Schuller | 194/10 |
| 4,512,453 A | | 4/1985 | Schuller et al. | 194/1 |
| 4,706,202 A | | 11/1987 | Kobayashi et al. | 364/479 |
| 5,184,708 A | | 2/1993 | Levasseur | 194/217 |
| 5,542,519 A | | 8/1996 | Weston et al. | 194/217 |
| 5,595,277 A | | 1/1997 | Hoormann et al. | 194/217 |
| 6,045,443 A | | 4/2000 | Weston et al. | 453/17 |
| 6,055,521 A | | 4/2000 | Ramsey et al. | 705/413 |
| 6,363,164 B1 | * | 3/2002 | Jones et al. | 382/135 |

FOREIGN PATENT DOCUMENTS

JP 2002074406 3/2002

* cited by examiner

*Primary Examiner*—Kenneth W. Noland
*Assistant Examiner*—Jeffrey A. Shapiro
(74) *Attorney, Agent, or Firm*—Squire, Sanders & Dempsey, L.L.P.

(57) ABSTRACT

A system which will allow a bill acceptor and dispenser to be incorporated into a vending machine operating on a standardized vending machine protocol to allow the vending machine to dispense change in the form of coins and/or currency according to the amount of change to be dispensed and the availability of specific denominations of coins and currency.

6 Claims, 4 Drawing Sheets

VENDING MACHINE HAVING DIRECT DATA LINK TO CASH DISPENSER

This application is a continuation-in-part of U.S. application Ser. No. 09/722,856 filed Nov. 27, 2000, now U.S. Pat. No. 6,742,644 hereby incorporated by reference.

BACKGROUND OF THE INVENTION

1. Field of the Invention

The present invention is generally directed to the field of vending machines and in particular to vending machines utilizing standardized control systems into which a bill acceptor-dispenser is incorporated to allow the vending machine to provide currency or coins as change.

2. General Background and State of the Art

Vending machines are in widespread use for the convenient dispensing of small, low cost items like drinks, candy, snacks and tobacco products. Originally, vending machines were coin only machines having the ability to accept and validate coins and a limited ability to make change. The development of bill validating devices allowed the incorporation of such devices into coin operated vending machines, allowing a vending machine to accept selected denominations of paper currency and credit the face value of the currency for allowing purchase of an item. Once an item for purchase is selected, any remaining credit would be dispensed as change in coins. To allow the incorporation of bill acceptors into vending machines, a standardized data protocol has been developed and adopted by The National Automatic Merchandising Association, NAMA®, in cooperation with the European Vending Association. A "Multi-Drop Bus/Interface Communication Protocol (MDB/ICP) Standard, Version 3.0 was adopted by NAMA® (in March 2003. This standard allows a bill validator to communicate with the vending machine controller ("VMC"), generally a microprocessor, and the VMC to communicate with the coin accepting device or changer.

However, the incorporation of bill acceptors in vending machines created a situation where users would more commonly use bills as opposed to coins to make purchases, resulting in bills being accepted and coins being dispensed without the coin collection tubes being replenished by coins input by the customers. This may result in an increase in the number of service calls required to replenish the coins in the coin changer while bills are removed from the bill acceptor. The depletion of even one specific coin denomination could result in the need for a service call or the inability to vend certain items as correct change could not be provided.

Thus, a need arose to try and manage the selection of coin denominations to be dispensed as change to attempt to minimize service calls. For example, U.S. Pat. No. 6,045,443 issued to Weston et al. discloses a method and apparatus for controlling the dispensing of coins as change from a vending machine. The method determines a combination of coins to be dispensed as change by determining a plurality of different possible combinations and selecting the most favorable one to conserve the remaining coins. The most favorable combination is the one determined to leave the greatest number of coins available for change according to a predetermined criterion that takes into account the number of currently available coins. This solution may forestall, but not eliminate, the problems associated with rapid depletion of the coins available to provide change in a vending machine which includes a bill acceptor.

The development of bill accepting machines which would also allow the dispensing of bills as change, a bill acceptor-dispenser, allowed systems to be developed that would take in either currency or coins, the selection of a purchase item, and the dispensing of change in the form of currency and/or coins. Sophisticated systems have been developed to control such integrated systems, as discussed for example in U.S. Pat. No. 4,499,982 issued to Sugimoto et al., which discloses a vend judgment device for an integrated vending machine assembly. The vend judgment device keeps track of the number of each denomination of coin and bill accepted by the machine, and each are stored in respective storage boxes within the machine. When a deposit is made, the vend judgment device counts up the number of deposited coins and bills in their respective denominations and counts down the number of paid out coins and bills in their respective denominations when change is made. The vend judgment device determines whether an item may be dispensed from the vending machine by calculating whether proper change may be dispensed from the vending machine. However, separately storing each denomination of bill in the vending machine makes this system both space intensive and substantially increases the number of components to transport the bills to their respective stacker, which compounds the potential note jam points which may require servicing. The space intensive requirement of this type of system is particularly problematic as the vending machine operator prefers a machine which maximizes the space available to store the products to be sold, not empty space required to hold potential currencies which may or may not be received.

The development of convenience devices which accept higher denominations of currency to allow the purchase of more expensive items, for example gasoline for an automobile, while still allowing the dispensing of currency and/or coins as change was inevitable. U.S. Pat. No. 6,055,521 issued to Ramsey et al. discloses an integrated cash station and change dispensing system to be used at a gas station to accept and dispense currency, or coins, or a combination of both. The '521 patent teaches a cash console that instructs a currency and change dispensing means to dispense an appropriate amount of change to a purchaser upon completion of a transaction. In this regard, the cash console instructs the coin dispenser to dispense appropriate coins to the change drawer and instructs a currency dispenser to dispense an appropriate number of bills to the change drawer. The system according to the Ramsey '521 patent is not concerned with maximizing the space in a vending machine dedicated to holding product as it is primarily a cash receipt system with an electronic control signal output to a separate dispensing device, a gas pump.

The foregoing described devices of the Sugimoto and Ramsey patents are not suitably designed to be incorporated into vending machines, particularly those utilizing the established vending machine communication protocols. Accordingly, a need arises for a system which will allow a bill acceptor and dispenser to be incorporated into a vending machine operating on a standardized vending machine protocol to allow the vending machine to dispense change in the form of coins and/or currency according to the amount of change to be dispensed and the availability of specific denominations of coins and currency.

INVENTION SUMMARY

The present invention is directed to a system which will allow a bill acceptor and dispenser to be incorporated into a vending machine operating on a standardized vending machine protocol to allow the vending machine to dispense change in the form of coins and/or currency according to the amount of change to be dispensed and the availability of specific denominations of coins and currency.

DETAILED DESCRIPTION OF THE PREFERRED EMBODIMENTS

The present invention can be used in automated sales machines and pay point machines, where a combination of currency and change may be required to be paid out to customers. For purposes of detailing the invention, however, the description herein is tailored to the application of the invention in a vending machine operating under the NAMA protocol. It is to be understood that while a typical can or bottle type of vending machine is depicted and described, the invention is applicable to other types of vending machines.

Figure 1:
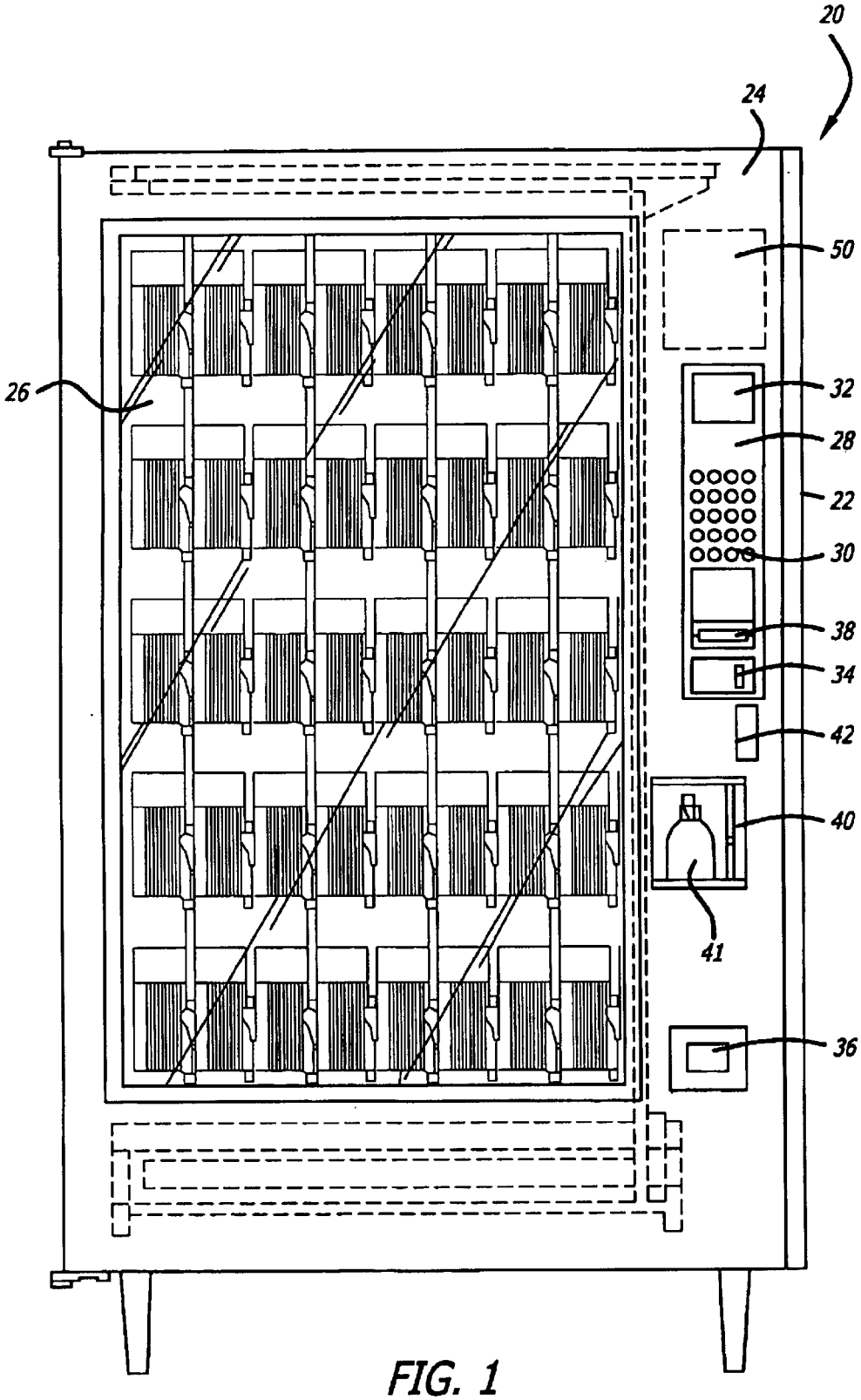
FIG. 1 shows a representative vending machine operating on the NAMA protocol including the system incorporating a bill acceptor-dispenser to provide change in the form of currency or coins, as appropriate, according to the present invention.

FIG. 1 depicts a vending machine 20 including an outer chassis or cabinet 22 and a front hinged door panel 24, which in combination define an inner cavity for housing the products to be vended, the control and refrigeration (if necessary) functions of the machine and other vending machine features well-known in the art. The front door panel 24 can frame a transparent glass or clear plastic panel 26 which provides a clear view into the internal cavity of the cabinet and the products stored in ordered manner on trays therein when the door panel 24 is closed. The door panel 24 includes an appropriate control panel, generally indicated at 28 which includes a product selection input keypad 30 and monetary and credit processing and display system 32, well-known in the art. Those skilled in the art will readily recognize many appropriate control panels and features thereof that could be used in association with a vending machine as hereinafter described.

The door panel 24 illustrated in FIG. 1 also includes a coin insert slot 34 and a coin return slot 36, associated with a coin acceptor/changer contained behind the door panel 24. In addition, the door panel 24 includes an opening through which projects a bezel assembly 38 of a bill acceptor-dispenser (described below) which is also disposed behind the door panel 24.

The door panel 24 also includes a product delivery port, generally indicated at 40, which is approximately at thigh or waist level and depicted with its door in an "open" position in FIG. 1, with a vended bottle product 41 illustrated through the open door. A locking handle assembly 42 enables the door to be opened and closed in secured manner for purposes of maintenance, loading of the machine, and the like.

The vending machine 20 includes a vending machine controller (VMC) 50 behind the door panel 24. The VMC 50 is responsible for controlling the operation of the vending machine 20. A bill acceptor-dispenser 60 within the vending machine 20 is electrically coupled to the VMC 50 and it is adapted to receive and selectively dispense paper currency as discussed in greater detail below. A coin acceptor/changer within the vending machine 20 is electrically coupled to the VMC 50 and it is adapted to receive, hold and dispense coins or tokens in a known fashion. The VMC 50 monitors the deposit of coins or currency, allows the selection of an item to be purchased and the deduction of the purchase price from the credited amount received, and, if necessary, the dispensation of any change to the customer.

To purchase products from a vending machine 20, a customer inserts coins, bills or other currency through the appropriate slot, the authenticity is tested and if valid the amount is determined and accumulated as credits in the VMC 50 for vending selected products. The received coins are directed to the coin acceptor/changer for validation and storage. Alternatively, the customer can insert bills or currency into the currency acceptor-dispenser 60, which receives notes as legal tender or script and, based upon the note's value, assigns a corresponding value of credits within the vending machine 20 for vending selected products.

According to the present invention, the bill acceptor-dispenser 60 is disposed in the cabinet 22 of the vending machine 20, and electrically connected to the VMC 50 therein. Preferably, the acceptor-dispenser 60 is of a size and configuration to be received within the cabinet 22 at the location previously occupied by prior bill validating devices so that no extensive reconfiguration or redesign of the vending machine 20 is required.

Figure 2:
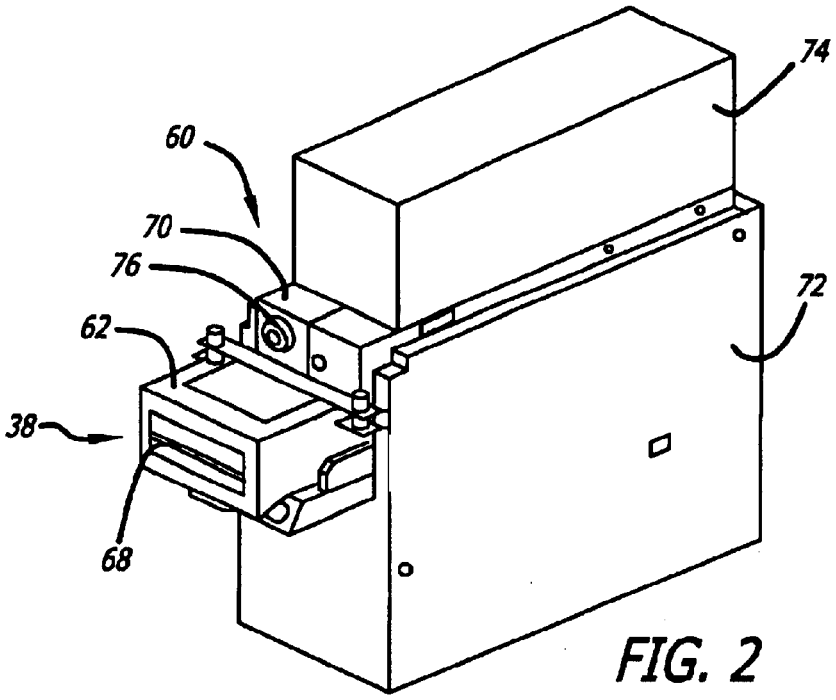
FIG. 2 shows a perspective view of the bill acceptor-dispenser including the note box and note hopper assembly for use in the present invention.

The acceptor-dispenser 60, as shown in FIG. 2, includes a validator 62 having a validator head adapted to scan a bill, paper currency or generally a "note" inserted into an opening 68 of the bezel assembly 38 to determine the authenticity, type (of legal tender), denomination and condition (whether the note is worn) of the note. Typically the note is inserted into the opening 68 and is captured and transported by a transportation unit 70 past optical and magnetic sensors which may, for example, sense light reflected by and/or transmitted through the note, reflectivity and transmission patterns, size of the note and the magnetic characteristics of the inserted note. The various sensors output sensed data output signals which are compared by a validator processor to stored data representative of the range of sensor readings corresponding to authentic notes.

If the note is determined valid and authentic, based on the comparison with the stored data for authentic notes, the transportation unit 70 transports the note to one of a note box 72 or a note hopper 74 for storage. Also, upon receipt and determination of validity, a signal is sent to the vending machine's VMC 50 signifying receipt as well as the denomination of the note for accumulation of a like value amount of credits in the vending machine 20. If the note is not determined valid, the transportation unit 70 is reversed and the note is ejected through the opening 68 to the customer.

The note box 72 is preferably positioned below the transportation unit 70, as shown in FIG. 2. The note hopper 74 may be positioned above the transportation unit 70 to take advantage of open space in many existing vending machines, however the note hopper can be stacked above, behind or below the note box 72, both of which may be either above or below the transportation unit 70. The note hopper 74 and note box 72 are secured to the transportation unit 70 to form the acceptor-dispenser 60. To prevent theft of notes during service of the vending machine 20, the attachment of the note box 72 may include a locking mechanism 76 which opens the note box 72 to allow receipt of notes from the transportation unit 70 only when the note box 72 is locked to the acceptor-dispenser 60. When the note box 72 is unlocked for removal, the locking mechanism 76 closes the note box 72 to prevent removal of notes stored therein.

The notes received into the note box 72 are typically stacked in a vertical relationship and accordingly the note box 72 has a configuration corresponding to the plan dimensions of the notes. The acceptor-dispenser 60 according to the present invention also includes the note hopper 74 adapted to receive and store notes in a stacked relationship.

The transport unit 70 is adapted to move notes through the validator 62 to a selected one of the note box 72 or note hopper 74. To control the transportation unit 70, the acceptor-dispenser 60 includes a unit controller 78 (FIG. 3), which is in communication with the validator 62 as well as the vending machine's VMC 50. Motorized means within the transportation unit 70 such as motorized traction wheels, belts, conveyers and gates, under control of the unit controller 78, selectively move the notes accepted as being valid.

The unit controller 78 also includes a data structure or memory 80 (FIG. 3) storing data concerning the notes stored in the note hopper 74 including at least data corresponding to the number of notes stored in the note hopper 74. Similarly, the unit controller 78 and memory 80 preferably have the ability to store data concerning the number and type of notes stored in the note box 72. Moreover, the unit controller 78 and memory 80 associated therewith optimally can also provide status and activity information, including for example dispensing or accepting status, fault conditions, any "note hopper empty" condition, a note hopper or transportation unit jam or a note hopper absence condition. It may also be beneficial to have memory devices, such as contact memory devices known in the art, integral with the note hopper 74 and the note box 72, such memory devices being configured to receive data from the unit controller 78 concerning the status of the notes which should be present in the respective device. All of the data available in the memory 80 may be remotely accessible from the unit controller 78 by the vending machine's VMC 50.

Figure 3:
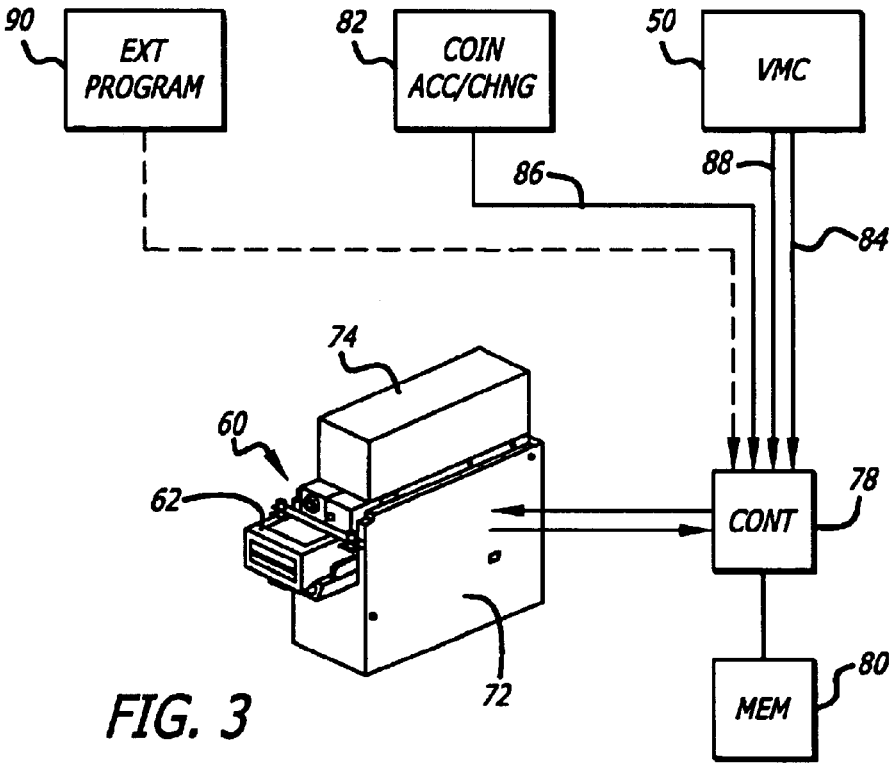
FIG. 3 illustrates the control system configuration of the bill acceptor-dispenser coupled to the vending machines VMC according to the present invention.
Figure 4:
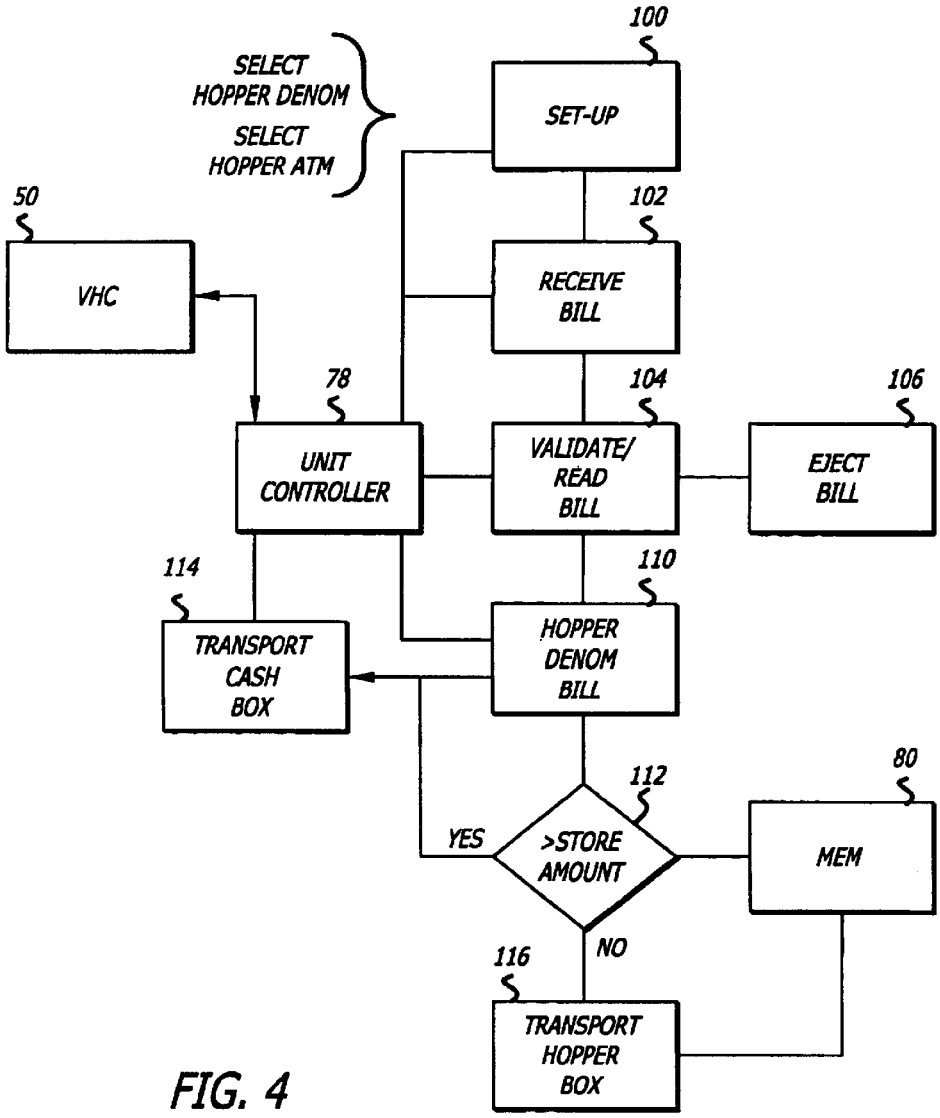
FIG. 4 is a logic diagram showing the note validation and note storing dispensing features of the control system for operating the system according to the present invention.

With reference to FIGS. 3 and 4, the logic of the operation of the acceptor-dispenser 60 and method of the present invention is illustrated using block diagrams. The unit controller 78 (FIG. 3) is first configured in the block diagram of FIG. 4 during a set up procedure, shown by box 100, to select the denomination/type of note to be sent to and stored in the note hopper 74 as well as the selected number of notes to be routed to and stored therein. The configuration at set up 100 may be by a command or series of commands from the vending machine's VMC 50 or by a portable, handheld device to be coupled to and in communication with the unit controller 78 and VMC 50 as shown in FIG. 3. The configuration or set up at 100 of the acceptor-dispenser 60 may also include input of data into the memory 80 of data corresponding to the number of notes pre-loaded into the hopper box 74 for dispensing thereof in the manner described below.

As an example of how the acceptor-dispenser 60 may be operated, the unit controller 78 may be configured to store a minimum of five to fifty notes in the note hopper 74 with a beginning inventory of twenty such notes. The number, denomination or type of note, minimum note quality and starting inventory can be selectively changed to store another denomination or type, or to store script notes only, store only less worn (i.e. higher quality) notes or any combination thereof. These instructions, may be downloaded from the VMC 50 or by a portable controller 90, as shown in FIG. 3.

Once instructed, the unit controller 78 controls the transportation unit 70 to deliver newly received notes accepted by the validator and meeting the preset criteria to the note hopper 74, until instructed otherwise. For example, the unit controller 78 may be instructed to store a minimum of one hundred notes and up to a maximum of four hundred notes depending upon the anticipated number and frequency of payouts. Additionally, the note hopper 74 may be loaded with an inventory of notes. The notes in the note hopper 74 are the only notes which may be dispensed as change.

To purchase an item from the vending machine 20, a customer inserts a note (step 102) into the validator opening 68. The note is transported through the validator 62 to scan the note. Data from the validator's sensors is transmitted to the unit controller 78, which, at step 104, compares the data to stored data to determine the note's authenticity, denomination, type and condition. If the note is not determined to be authentic, unit controller 78 rejects the note at step 106 and controls the transportation unit 70 to reverse the direction of the drive transport and thereby expel the note through the validator opening 68 and back to the customer. If the note is determined to be authentic, the denomination or value of the note is transmitted by the unit controller 78 to the VMC 50. The VMC 50 establishes a corresponding value amount of credits in the vending machine 10 to allow the customer to make a selection and displays the amount on the display system 32 of FIG. 1.

The data for the note is also compared within the unit controller 78 to determine at 110 if the note is of a type, denomination and condition or quality selected for storage in the note hopper 74. If it is, the unit controller 78 at step 112 further interrogates the memory 80 to determine if the maximum storage number of notes to be stored in the note hopper 74 has been met. If the number of notes in the note hopper 74 is less than the instructed maximum number, the note is routed to the note hopper 74 at step 116. If the maximum number of notes in the note hopper 74 has already been stored in the note hopper 74, the unit controller 78 controls the transportation unit 70 to transport the received note at step 114 to the note box 72.

When a note is transported to the note hopper 74, the memory 80 is updated to indicate that a note has been added to the note hopper 74. Thus, the memory 80 keeps a running total of the number of notes stored in the note hopper 74 to preferentially maintain a pre-selected number of notes to be stored therein. When a pre-selected maximum number of notes to be stored in the note hopper 74 has been met, additional notes, even though they may be of the denomination, type and condition which would normally be stored in the note hopper 74, are sent to the note box 72 for storage. If the validated note is not of the pre-selected type to be stored in the note hopper 74 the transportation unit 70 is instructed at step 114 to send the note to the note box 72.

When a customer completes a transaction or wishes to cancel the transaction to have the accumulated credits refunded, an appropriate instruction is sent to the vending machine's VMC 50. The VMC 50 calculates the amount of the change to be dispensed and sends out a dispense signal. For vending machines having a "level 2" coin acceptor/ changer 82, the dispense signal indicates the coin type(s) and number(s) of each coin to be dispensed. For "level 3" coin acceptor/changers 82, the VMC 50 may simply provide an instruction on line 84 directed to the coin acceptor/changer 82 of the amount of the payout anticipating that the coin acceptor/changer will determine combination for the coin payout.

In the system according to the present invention, the signal on line 84 from the VMC 50 to the coin acceptor/changer is routed to the unit controller 78 of the acceptor-dispenser 60. Therein, the unit controller 78 determines if the signal is a level 2 or level 3 instruction, establishes the amount of the payout instruction, and determines if the payout should be made at least in part by dispensing a bill from the note hopper 74.

If the amount of the payout is less than the stored note denomination, the instruction is passed from the unit controller 78 to the coin acceptor/changer 82 on line 86 and the payout is made exclusively by the coin acceptor/changer to the customer. If the payout can be made utilizing the stored denomination note, e.g. where the vending machine 20 is a minimum five cent unit machine, the denomination of notes stored in the note hopper 74 is one dollar notes and the payout is greater than twenty units, the calculation is made by the unit controller 78 of acceptor-dispenser 60 and the appropriate combination of notes is dispensed from the note hopper 74. Any remaining payout in an amount less than the denomination of the notes in the note hopper 74 to satisfy the remainder of the payout is sent to the coin acceptor/changer 82. The bill acceptor-dispenser's unit controller 78 thus intercepts the signal from the VMC 50 and controls the coin acceptor/changer 82 to dispense the requisite number of coins derived from the calculation for the payout and sends an instruction to control the transportation unit 70 to sequentially retrieve one or more notes from the note hopper 74 for dispensing.

Under instruction from the unit controller 78, the transportation unit 70 serially retrieves and transports the required number of notes from the note hopper 74 through the validator head 66 for dispensing through the opening 68 for the payout. In this process, as a note is dispensed, the validator head 66 senses the note and sends a signal to the unit controller 78 and memory 80 to account for the dispensing of the note for the payout. To prevent notes from stacking one behind the other, the validator head 66 also senses the removal of the note from the opening 68 by the customer before an instruction is sent to the unit controller 78 to dispense another note. As notes are dispensed, the memory 80 is updated and the number of dispensed notes is deducted. Thus the memory 80 keeps a running tally of notes stored in the note hopper 74. Further, as notes are dispensed, a signal is sent to the vending machine's VMC 50 on line 88 to account for the dispensing of notes and coin/tokens until the payout is complete.

The acceptor-dispenser 60 preferably has the capability of monitoring the number of notes in the note hopper 74, the status of the note hopper 74 and the status of the transportation unit 70. Thus, the system can determine or detect when all notes are depleted from the note hopper 72 and any jamming of notes in the note hopper 74 or transportation unit 70. It may be beneficial to include a security protocol, for example a password or encryption system, to limit access to the unit controller's program so that the system cannot be changed so as to store or dispense a different denomination of note from the note hopper 74 absent proper authorization. As another security feature, the controller can be programmed so as to preclude any change being made to the denomination of note to be directed to the note hopper 74 if there are any notes in the note hopper 74. Further, the controller is preferably programmed to allow control over the maximum number of notes dispensed on a payout and the maximum number of notes that can be dispensed in a specified amount of time.

As an example of an alternative embodiment of the contemplated invention which would be readily apparent to those skilled in the art following review of the foregoing detailed description, the notes dispensed by the dispensers may be provided through a second opening, distinct and spaced apart from the opening which receives notes to be scanned by the validator. Such an arrangement would have the benefit of decreasing the wear on the validator head units. Accordingly, when a note is to be dispensed, the transportation unit would transport the note to the second opening for dispensing to a customer.

While the foregoing describes certain embodiments of the present invention, it is to be understood that it is subject to many modifications and changes without departing from the spirit and scope of the appended claims.

Figure 5:
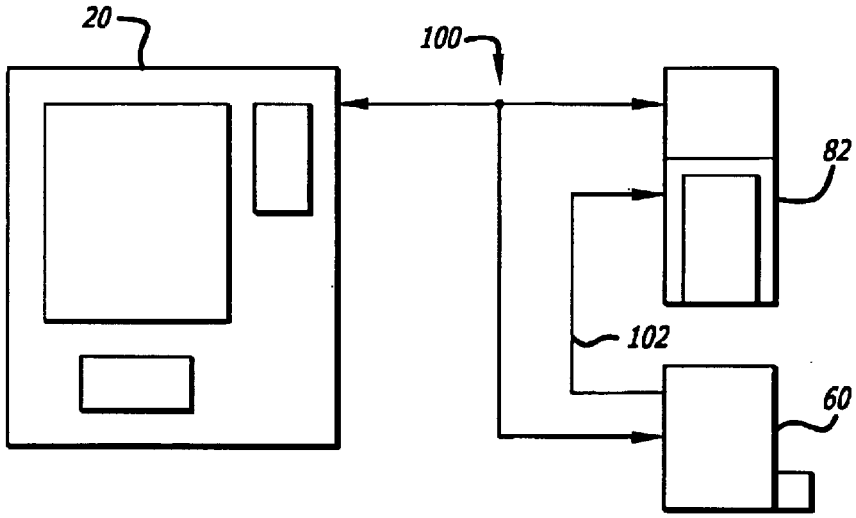
FIG. 5 is a simplified schematic drawing of the first embodiment of the invention wherein the change instruction from the VMC is directed to the bill acceptor-dispenser.
Figure 6:
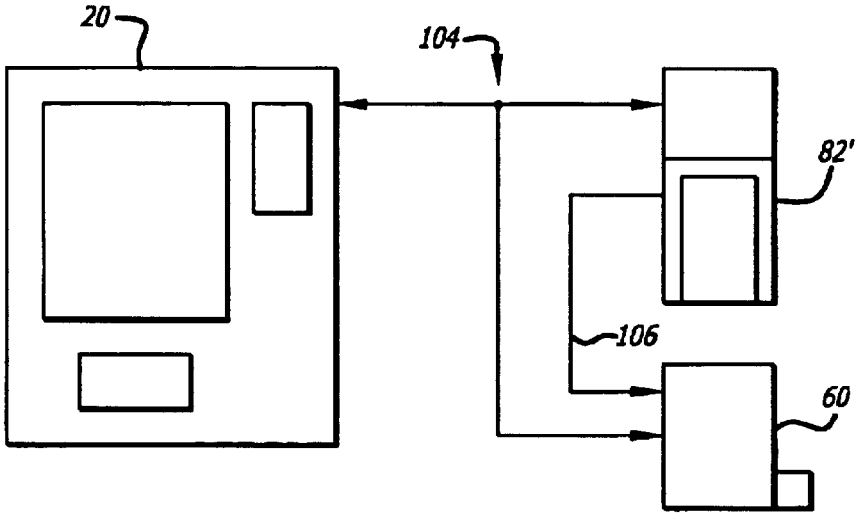
FIG. 6 is a simplified schematic drawing of a second embodiment of the invention wherein the change instruction from the VMC is directed to the coin acceptor/changer.

FIGS. 5 and 6 are provided to depict in a simplified schematic drawings the implementation of the present invention into a vending machine. In FIGS. 5 and 6, the vending machine 20 includes the coin acceptor/changer 82 and the note acceptor dispenser 60 which replaces the prior art bill acceptors which were not capable of dispensing notes.

In FIG. 5, a wiring harness 100 interconnects the VMC 50 of the vending machine 20 to the note acceptor-dispenser 60 and the coin acceptor/changer 82. In the wiring harness 100, the output signal from the VMC 50 directed to the coin acceptor/changer 82 is routed to the note acceptor-dispenser 60. A connection 102 from the note acceptor-dispenser 60 to the coin acceptor/changer 82 provides the path by which the coin acceptor/changer 82 is instructed to dispense coins as change.

In FIG. 6, by comparison, a wiring harness 104 interconnects the VMC 50 of the vending machine 20 to the note acceptor-dispenser 60 and the coin acceptor/changer 82. In the wiring harness 100, the output signal from the VMC 50 directed to the coin acceptor/changer 82, as is the case in prior art systems according to the NAMA protocol. The coin acceptor/changer 82' of this embodiment, however, would be upgraded to allow it to output a signal to the note acceptor-dispenser via path 106 with an instruction to dispense one or more notes from the note hopper as change. In this configuration, the coin acceptor/changer 82' would report the coin inventory and change output to the VMC 50 after each transaction.

What is claimed is:

1. A vending machine for vending products including a coin acceptor/changer and a bill acceptor-dispenser for receiving and dispensing money, the vending machine comprising:

a cabinet and a door defining an inner cavity for housing products, a vending machine controller for controlling the operation of the vending machine based on a standardized vending machine protocol program;

a note acceptor-dispenser for receiving notes, said note acceptor-dispenser including:

a validator head for sensing data relating to the authenticity, denomination, and type of note inserted into said validator and for generating signals corresponding to the sensed data for each received note;

a validator processor for receiving and comparing said sensed data signals with stored data to validate the authenticity of said notes and for generating a signal signifying receipt and the value of said note to said vending machine controller;

a note box configured to receive and hold notes received by said note acceptor-dispenser validator;

a note hopper for receiving and storing pre-selected characteristic notes received by said note acceptor-dispenser validator; and a transportation unit for directing said notes determined to be authentic to one of said note box and said note hopper and for dispensing notes from said note hopper in response to a signal received by said note acceptor-dispenser from said vending machine controller;

a coin acceptor/changer for receiving and validating coins and generating a signal signifying receipt and value of received coins to said vending machine controller;

said vending machine controller having a program to calculate change to be dispensed by the vending machine and outputting a signal indicative of the change to be dispensed, said signal being redirected to said note acceptor-dispenser; and said note acceptor-dispenser controlling the disbursement of currency and coins by said vending machine.

2. The vending machine of claim 1 wherein said note acceptor-dispenser further comprises:

a controller for maintaining a running accounting of the number and denominations of the notes contained in each of said note hopper and said note box.

3. The vending machine of claim 1 wherein said note acceptor-dispenser further comprises:

a controller for controlling the operation of the note acceptor-dispenser, said controller being capable of changing the characteristic used for directing notes to said note hopper.

4. The vending machine of claim 1, further comprising:

a processor for calculating the number of notes to be dispensed from said note hopper and the number of coins to be dispensed from said coin hopper to provide a combination of notes and coins to total an amount to be dispensed as specified by said vending machine controller.

5. A note acceptor-dispenser for receiving and dispensing money in a vending machine having a vending machine controller for controlling the operation of the vending machine based on a standardized vending machine protocol program and a coin acceptor/changer for receiving and validating coins and generating a signal signifying receipt and value of received coins to the vending machine controller;

the note acceptor-dispenser comprising:

a validator head for sensing data relating to the authenticity, denomination, and type of note inserted into said validator and for generating signals corresponding to the sensed data for each received note;

a validator processor for receiving and comparing said sensed data signals with stored data to validate the authenticity of said notes and for generating a signal signifying receipt and the value of said note to said vending machine controller;

a note box configured to receive and hold notes received by said note acceptor-dispenser validator;

a note hopper for receiving and storing pre-selected characteristic notes received by said note acceptor-dispenser validator; and a transportation unit for directing said notes determined to be authentic to one of said note box and said note hopper and for dispensing notes from said note hopper in response to a signal received by said note acceptor-dispenser from said vending machine controller.

6. The note acceptor-dispenser of claim 5 further comprising a controller for controlling the disbursement of currency and coins from said vending machine.

* * * * *